US007536855B2

(12) United States Patent
Tsukahara

(10) Patent No.: US 7,536,855 B2
(45) Date of Patent: May 26, 2009

(54) EXHAUST CONTROL DEVICE FOR WATER JET PROPULSION BOAT

(75) Inventor: Koju Tsukahara, Shizuoka-ken (JP)

(73) Assignee: Yamaha Hatsudoki Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 11/140,879

(22) Filed: May 31, 2005

(65) Prior Publication Data

US 2006/0026951 A1 Feb. 9, 2006

(30) Foreign Application Priority Data

May 28, 2004 (JP) ..... 2004-158646

(51) Int. Cl.
*F01N 7/00* (2006.01)

(52) U.S. Cl. ..... 60/324; 60/298

(58) Field of Classification Search ..... 60/298, 60/299, 324; 440/89
See application file for complete search history.

(56) References Cited

U.S. PATENT DOCUMENTS 4,997,399 A * 3/1991 Nakayasu et al. ..... 440/89 F
5,212,949 A * 5/1993 Shiozawa ..... 440/89 H
5,408,827 A * 4/1995 Holtermann et al. ..... 60/298
5,433,073 A * 7/1995 Duret et al. ..... 60/288
5,554,057 A * 9/1996 Abe et al. ..... 440/89 R
5,809,776 A * 9/1998 Holtermann et al. ..... 60/288
5,845,486 A * 12/1998 Yamashita et al. ..... 60/274
5,911,609 A * 6/1999 Fujimoto et al. ..... 440/89 R
6,116,022 A * 9/2000 Woodward ..... 60/300
6,220,907 B1 * 4/2001 Shimizu ..... 440/89 R
6,511,355 B1 * 1/2003 Woodward ..... 440/89 H

FOREIGN PATENT DOCUMENTS

JP 11-157494 6/1999

* cited by examiner

*Primary Examiner*—Thomas E Denion
*Assistant Examiner*—Diem Tran
(74) *Attorney, Agent, or Firm*—Knobbe, Martens, Olson & Bear, LLP

(57) ABSTRACT

A watercraft has an exhaust conduit that includes an exhaust gas passage and a cooling water passage. The exhaust gas passage and the cooling water passage are configured to mix together an exhaust gas flow and a cooling water flow at a junction. The mixture is ultimately discharged from the watercraft. The watercraft has an exhaust valve drive system that has a drive motor and a controller. The exhaust valve drive system operates an exhaust control valve to control the flow of exhaust gases through the exhaust conduit. The exhaust control valve includes a pivot shaft extending generally horizontally and attached to a valve body. The exhaust control valve is positioned upstream of the junction. The controller operates the drive motor which drives the exhaust control valve between an open position and closed position. The controller can receive signals from an engine rotation sensor and a throttle opening sensor and can control the drive motor based on these signals. A catalyst for treating the exhaust gases is disposed upstream in the exhaust gas passage along the exhaust control valve.

21 Claims, 4 Drawing Sheets

EXHAUST CONTROL DEVICE FOR WATER JET PROPULSION BOAT

PRIORITY INFORMATION

The present application is based on and claims priority under 35 U.S.C. § 119(a-d) to Japanese Patent Application No. 2004-158646, filed on May 28, 2004, the entire contents of which is expressly incorporated by reference herein.

BACKGROUND OF THE INVENTIONS

1. Field of the Inventions

The present inventions relate to an exhaust system and, more specifically, to an exhaust system for a marine engine that includes an exhaust control valve for adjusting the exhaust pressure of exhaust gases.

2. Description of the Related Art

Watercrafts, such as water jet propulsion boats, produce a propulsion force that is generated by jetting water rearwardly from its stem. Water is typically introduced through the bottom of a water jet propulsion boat to a jet pump. The jet pump discharges the water rearwardly to generate a propulsion force. Such water jet propulsion boats typically include an exhaust conduit. Exhausts gases discharged from the engine pass through the exhaust conduit towards an external location.

Japanese Patent Application No. HEI 11-157494 discloses exhaust conduits that have an exhaust control valve for adjusting the exhaust pressure of the exhaust gases to reduce the exhaust discharge noise and for affecting the engine output.

Water jet propulsion boats also typically have a water-lock positioned midway along the exhaust conduit. Exhaust gases pass through the water-lock before being discharged to the atmosphere. An exhaust control valve can be positioned within the exhaust conduit at a location downstream of the water-lock. The water jet propulsion boats can have a servo motor for driving the exhaust control valve and an engine control unit ("ECU") for controlling the operation of the servo motor.

The exhaust control valve is often moveable between a closed position and an open position. The ECU moves the exhaust control valve towards its closed position when the engine operates at a low speed and moves the exhaust control valve towards its open position when the engine operates at a high speed.

Exhaust conduits extending between the water-lock and the engine often have two passages; one passage through which the exhaust gases flow and a cooling water passage through which cooling water flows. The cooling water passage can be formed around an outer surface of the exhaust gas passage. The exhaust gas passage and the cooling water passage can merge the exhaust gas flow and the cooling water flow together at some point upstream of the water-lock.

The exhaust gas/cooling water mixture then flows into the water-lock. The internal pressure of the water-lock can be relatively high when the exhaust valve is closed. The high pressure in the water-lock can cause reverse the flow of the cooling water, i.e. towards the engine. If the pressure of the water-lock causes a reverse flow of the cooling water, the cooling water may enter the engine and impair engine performance.

When the engine operates at a high rotational speed, the period(s) of the exhaust pulses of the exhaust gases are generally shorter and the amplitude of the exhaust pulses are less than the period(s) of exhaust pulses produced when the engine operates at medium and/or low rotational speeds.

Thus, reverse flow of cooling water through the exhaust conduit is less likely to occur at high engine speeds as compared to low engine speeds. When the engine operates at mid-range or low rotational speeds, the period(s) of the exhaust pulses are longer and the amplitude of the pulses are relatively large thereby increasing the likelihood of having a reverse flow of cooling water. Accordingly, reverse flow of the cooling water through the exhaust conduit towards the engine can occur during typical engine operation.

SUMMARY OF THE INVENTIONS

An aspect of at least one of the embodiments includes the realization that an exhaust system can have an exhaust control device that can limit or prevent cooling water from reversely flowing towards an engine of a watercraft.

Thus in accordance with an embodiment, an exhaust system for a watercraft having an engine is provided. The exhaust system comprises an exhaust conduit, the exhaust conduit having an exhaust gas passage through which exhaust gases discharged from the engine pass and a cooling water passage through which cooling water that has cooled the engine passes. A junction merges the exhaust gases and cooling water and an exhaust control device comprises an exhaust control valve positioned between the junction and the engine. The exhaust control device is configured to control an opening of the exhaust control valve in response to an operating condition of the engine.

In accordance with another embodiment, an exhaust system for a watercraft having an engine is provided. The exhaust system comprises an exhaust conduit having an exhaust gas passage and a cooling water passage. The exhaust gas passage is in fluid communication with the engine. The cooling water passage is configured to receive water that has cooled the engine. A junction is connected to downstream ends of the exhaust gas passage and the cooling water passage so as to combine together exhaust gases flowing through the exhaust gas passage and cooling water flowing through the cooling water passage. An exhaust control device comprises an exhaust control valve positioned along the exhaust gas passage, wherein the exhaust control device is configured to actuate the exhaust control valve based on an operating condition of the engine.

BRIEF DESCRIPTION OF THE DRAWINGS

The above-mentioned and other features of the inventions disclosed herein are described below with reference to the drawings of preferred embodiments. The illustrated embodiments are intended to illustrate, but not to limit the inventions. The drawings contain the following Figures.

DETAILED DESCRIPTION OF THE PREFERRED EMBODIMENT

Figure 1:
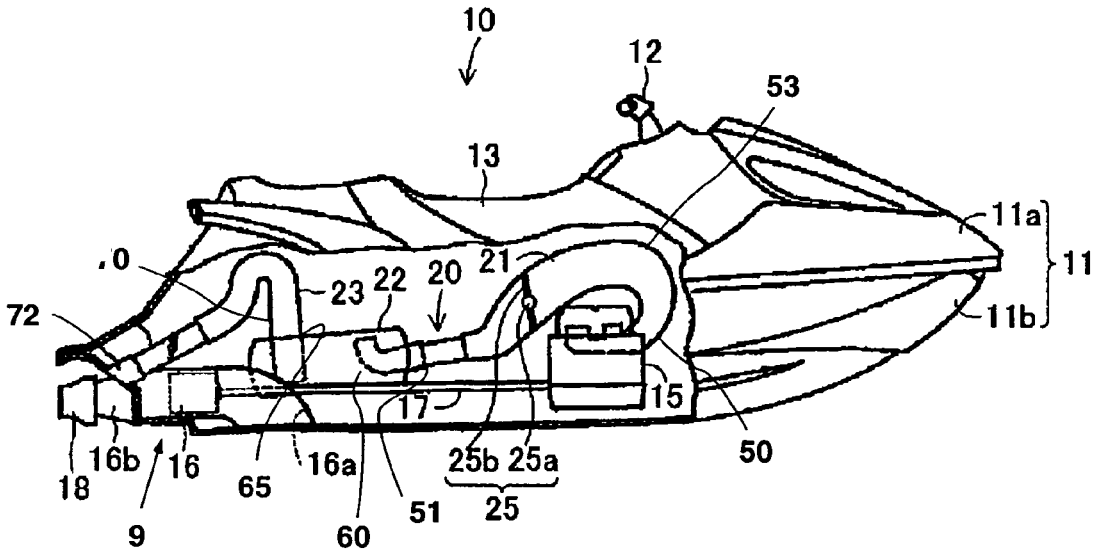
FIG. 1 is a partial cross-sectional, side elevation view of a watercraft having an exhaust system in accordance with an embodiment.

FIG. 1 illustrates a personal watercraft 10 having an exhaust control mechanism in accordance with several embodiments. The exhaust control mechanism is disclosed in the context of a personal watercraft because it has particular utility in this context. However, the exhaust control mechanism can be used in other contexts, such as, for example, but without limitation, outboard motors, inboard/outboard motors, and for engines of other vehicles including land vehicles.

The boat body 11 comprises a deck 11*a* and a hull 11*b*. A steering handle bar 12 can be disposed at an upper section of the deck 11*a*. A seat 13 can be disposed centrally along the boat body 11 so that an operator can straddle the seat 13 and grip the steering handle bar 12.

The bottom section of the hull 11*b* houses various components of the engine. For example, the illustrated watercraft 10 has a fuel tank 14 (FIG. 2) disposed in a forward area of the bottom section. An engine 15 is mounted in a central area of the bottom section in the boat body 11.

In some embodiments, including the illustrated embodiment of FIGS. 1 and 2, the engine 15 is mounted inside the boat body 11 below and somewhat forwardly of the seat 13. The fuel tank 14 can be positioned forwardly of the engine 15.

A jet pump unit 9 can be driven by the engine 15 to propel the illustrated watercraft 10. An impeller shaft 17 can extend between a crankshaft of the engine 15 and the jet pump unit 9. The impeller shaft 17 can be formed from a single shaft or a plurality of shafts connected together. The crankshaft of the engine 15 imparts rotary motion to the impeller shaft 17 which, in turn, drives the pump unit 9.

The jet pump unit 9 can be disposed within a tunnel formed on the underside of the lower hull 11*b*. The rearward lower surface (on the stern side) of the lower hull 11*b* can be raised upwardly from the bottom toward the inside of the body 11 to form a downwardly concaved portion, preferably extending laterally centrally of the body 11 in the longitudinal direction to the end of the stern.

The jet pump unit 9 preferably comprises a propulsion system 16, a discharge nozzle 16*b*, and a steering nozzle 18 to provide steering action. The steering nozzle 18 can be pivotably mounted about a generally vertical steering axis. The jet pump unit 9 can be connected to the handle bar 12 by a cable or other suitable arrangement so that a rider can pivot the steering nozzle 18 as desired. Other types of marine drives and configurations can also be used to propel the watercraft 10 depending upon the application.

The impeller shaft 17 is coupled to an impeller disposed within the propulsion system 16. The rotating impeller generates a propulsion force that drives the water jet propulsion watercraft 10.

The propulsion system 16 can include a water inlet port 16*a* (FIG. 1) in the bottom section of the boat body 11. Water can flow through the inlet port 16*a* and into the propulsion system 16. The water is jetted out through the discharge nozzle 16*b* as the impeller rotates and generates a propulsion force that propels the watercraft 10.

Figure 2:
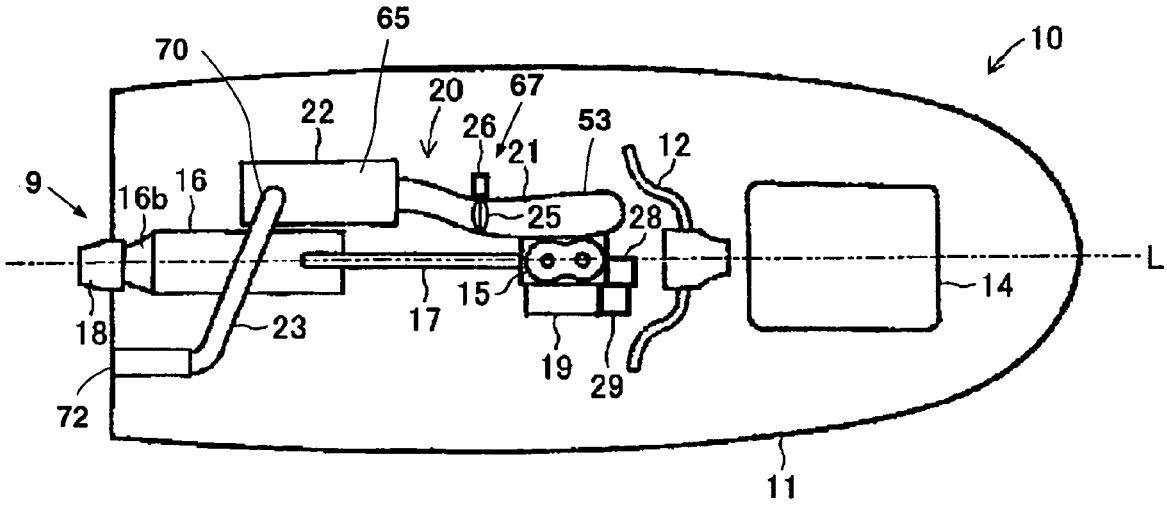
FIG. 2 is a top plan view of the watercraft of FIG. 1.

With continued reference to FIG. 2, the jet pump unit 9 can be mounted generally along the center line L of the watercraft 10. The illustrated propulsion system 16 is positioned at the aft end of the boat body 11 and is generally aligned with the center line L of the watercraft 10.

An intake system 19 and the exhaust system 20 can be connected to the engine 15. The intake system 19 can be configured to guide a mixture of fuel supplied from the fuel tank 14 and air to the engine 15 for combustion therein. The intake system 19 can comprise an air intake system that includes a throttle valve for adjusting an amount of air supplied to the engine 15. In some embodiments, the intake system 19 has a throttle opening detector for detecting an opening of the throttle valve and, thus, the amount of air delivered to the combustion chambers of the engine 15. The throttle opening detector can output a signal that is received by a controller.

The engine 15 can be a four-stroke, two cylinder engine. The engine 15 can have intake valves and exhaust valves both forming portions of the combustion chambers. The illustrated engine 15, however, merely exemplifies one type of engine that may be used with preferred embodiments of the exhaust system of the present application. Engines having other numbers of cylinders, having other cylinder arrangements, and other cylinder orientations (e.g., upright cylinder banks, V-type, and W-type) are all practicable. The engine 15 can also be configured to operate on any combustion principle, such as, for example, but without limitation, four-stroke, two-stroke, rotary, diesel, etc. Most commonly, personal watercraft, such as water jet propulsion boats, include either a two-stroke or a four-stroke engine.

The engine 15 intakes a mixture of fuel and air through the intake system 19 and outputs combustion byproducts to the exhaust system 20. The illustrated engine 15 is interposed between the intake system 19 and the exhaust system 20.

In some embodiments, the intake system 19 can be disposed on a side of the engine 15 with intake valves. The intake system 19 draws in ambient air and delivers the air to the intake valves, which in turn controllably deliver the air to the combustion chambers. The engine 15 can discharge exhaust gases through exhaust valves to the exhaust system 20.

In operation, the intake system 19 draws air from the internal cavity defined within the boat body 11 into combustion chambers within the engine 15 during downward movement of pistons (e.g. the intake stroke) within an engine body of the engine 15. When the throttle valve is closed, only a small amount of air enters the engine body.

The exhaust system 20 provides fluid communication between the engine 15 and the external environment. The exhaust system 20 preferably emits exhaust gases discharged from the engine 15 to an external location at a rear end portion of the boat body 11. The intake system 19 and the exhaust system 20 cooperate to achieve the desired engine performance as described below.

The illustrated exhaust system 20 includes an exhaust conduit 21, a tank 22, and a discharge conduit 23. The exhaust conduit 21 provides fluid communication between the engine 15 and the tank 22. In some embodiments, the exhaust conduit 21 is a curved conduit having a first end 50 (FIG. 1) connected to the engine 15 and a second end 51 connected to the tank 22 which can be in the form of a water-lock.

The first end 50 of the exhaust conduit 21 preferably is in communication with the exhaust valves of the engine 15. The exhaust conduit 21 extends from each exhaust valve so that the exhaust gases from the combustion chambers of the engine 15 are mixed within and flow through the exhaust conduit 21.

As shown in FIG. 1, a central portion 53 of the exhaust conduit 21 extends forwardly and upwardly from the first end 50. The central portion 53 then curves rearwardly and downwardly to the water-lock 22. The second end 51 of the exhaust conduit 21 communicates with a front portion 60 of the water-lock 22. In some embodiments, the second end 51 is positioned forwardly of an exhaust conduit 23 that is coupled to the water-lock.

The discharge exhaust conduit 23 extends rearwardly from a rear top surface 65 of the water-lock 22. An upstream end 70 of the discharge exhaust conduit 23 communicates with the water-lock 22. In some embodiments, the discharge exhaust conduit 23 extends upwardly from the water-lock 22. The exhaust conduit 23 then extends downwardly and rearwardly to an exhaust outlet 72 positioned at the aft end of the watercraft 10. The exhaust outlet 72 is positioned at a rear bottom end of the boat body 11. When the water jet propulsion watercraft 10 floats in water, the exhaust outlet 72 is preferably submerged such that exhaust gases are emitted into the water.

Figure 3:
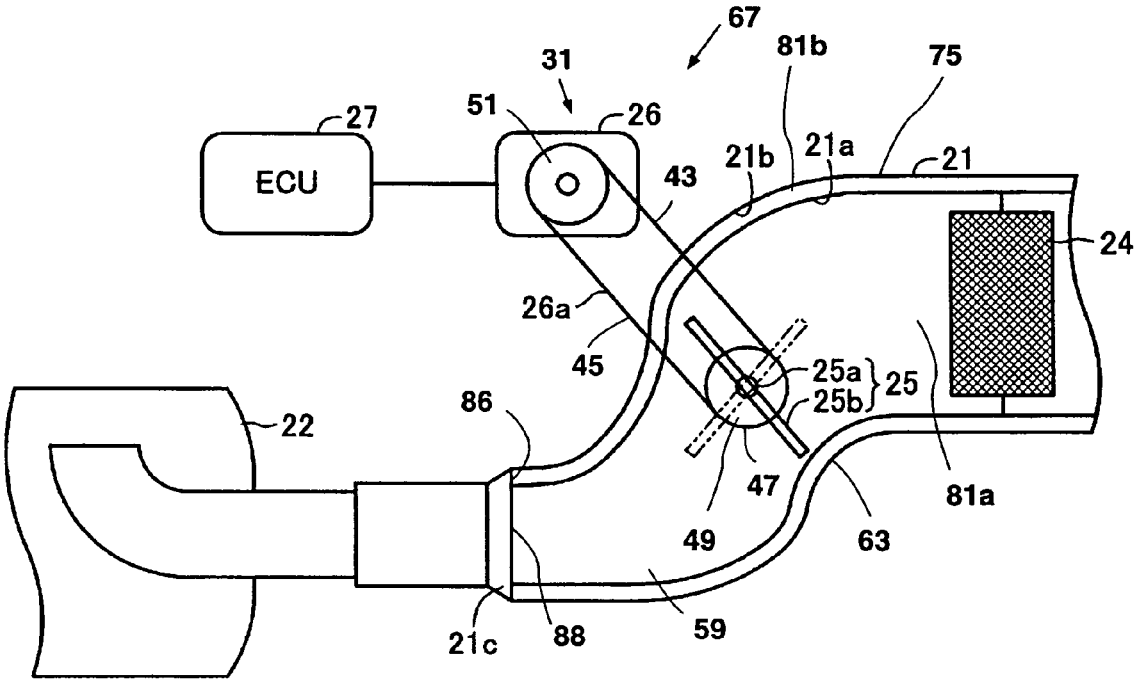
FIG. 3 is a cross sectional view of a portion of the exhaust system of FIG. 1, the exhaust system having an exhaust control device positioned in an exhaust conduit.

With respect to FIG. 3, at least a portion of the exhaust conduit 21 can have a plurality of passageways. The exhaust conduit 21 has an upstream portion 75 that has two passageways. The illustrated upstream portion 75 has an inner conduit 21*a* and an outer conduit 21*b* that are somewhat concentric. The inner surface of the inner conduit 21*a* defines an exhaust gas passage 81*a*. Exhaust gases outputted from the engine 15 can flow through the exhaust gas passage 81*a* towards the aft end of the watercraft 10.

A cooling water passage 81*b* is defined by an inner surface of the outer conduit 21*b* and the outer surface of the inner conduit 21*a*. Cooling water from the engine 15 can flow through the cooling water passage 81*b*. A cooling water passage outlet 86 of the passage 81*b* is configured to mix cooling water with exhaust gases flowing through the exhaust gas passage 81*b*. In the illustrated embodiment, exhaust gases passing through the exhaust gas passage 81*a* and the cooling water passing through the cooling water passage 81*b* are mixed with each other at a junction 21*c*. In some embodiments, the jet pump 9 can be used as a cooling water pump. For example, as is well known in the art, a cooling water passage can extend between the engine, and/or any other component that is to be cooled, to the jet pump 9. Thus, water that is pressurized by the jet pump 9 can be guided to the engine body and/or other components.

The junction 21*c* is preferably configured to promote mixing of the cooling water and exhaust gases. The illustrated junction 21*c* includes the cooling water passage outlet 86 and an exhaust gas passage outlet 88. The cooling water passing through the cooling water passage 81*b* comprises water that has cooled the engine 15.

For example, cooling water can be passed through one or more cooling water jackets disposed in or on the engine body to cool the engine 15. When the engine 15 operates, the combustion process heats the engine 15. The cooling water, which is cooler than the engine 15, flows through the cooling jackets and absorbs heat from the engine 15 to thereby cool the engine 15. The heated cooling water then passes through the exhaust system 20 and is ultimately emitted outside the watercraft 10.

The water flowing through the cooling water passage 81*b* may or may not be limited to water that is used to cool the engine 15. For example, water from other portions of the boat can be directly sent to the exhaust conduit 21 without passing through the engine 15, or a cooling jacket. Thus, the cooling water can comprise water that is not used to cool the engine 15.

An exhaust purification system can be in fluid communication with the exhaust gases. The exhaust purification system can comprise a catalytic converter or catalyst 24 for purifying the exhaust gases and is preferably disposed within the exhaust conduit 21.

The illustrated catalyst 24 is positioned in the exhaust gas passage 81*a* so that exhaust gases pass through the catalyst 24 before mixing with the cooling water. The catalyst 24 can remove combustion byproducts and/or unburned hydrocarbons from the exhaust gases and is positioned upstream of the exhaust control valve 25. As such the cooling water does not contact and impair the performance of the catalyst 24.

In some embodiments, the catalyst 24 has a honeycomb base material that is coated with platinum. However, other configurations and types of catalyst or catalytic converters can be used to remove combustion by-products and/or other substances from the exhaust gases.

The exhaust system 20 can have an exhaust control device 67 for regulating the flow of exhaust gases through the exhaust gas passage 81*b*. The exhaust control device 67 can include an exhaust control valve 25 that is positioned downstream of the catalyst 24.

An exhaust valve drive system 31 of the exhaust control device 67 can be configured to operate the exhaust control valve 25. The exhaust control valve 25 thus can be configured to selectively control the flow of the exhaust gases passing through the exhaust gas passage 81*a*.

The exhaust control valve 25 can include a pivot shaft 25*a* and a valve body 25*b*. The pivot shaft 25*a* preferably extends generally horizontally and defines an axis of rotation.

A further advantage is provided where the pivot shaft 25*a* is positioned above cooling water that may flow along the bottom 59 of the exhaust gas passage 81*a*. As such, the cooling water does not soak the pivot shaft 25*a*.

In the illustrated embodiment, the pivot shaft 25*a* can be positioned generally midway in the vertical direction within, the exhaust gas passage 81*a*. If the cooling water flows towards the engine 15 and reaches the control valve 25, the pivot shaft 25*a* is generally horizontally oriented so that the cooling water preferably does not soak the pivot shaft 25*a*. Thus, the cooling water is less likely to contact and erode the pivot shaft during various operating conditions.

The pivot shaft 25*a* can be connected to a pivot shaft portion 49 having an outer surface 47 that can engage a drive member 26*a* of the drive system 31. At least a portion of a central portion 63 of the exhaust conduit 21 extends upwardly to inhibit the flow of cooling water towards the engine 15.

In some embodiments, including the illustrated embodiment, the central portion 63 has a generally S-shaped configuration as shown in FIGS. 2 and 3. Thus, even if cooling water flows from the junction 21*c* towards the engine 15, the cooling water is collected at the bottom 59 of the exhaust gas passage 81*a* and does not flow past the exhaust control valve 25. Of course, the exhaust control valve 25 can be oriented (e.g., closed) to further inhibit the flow of cooling water towards the engine 15. The pivot shaft 25*a* can be vertically positioned above the water-lock 22 and/or the engine 15.

The exhaust control valve 25 can be configured to open and close an exhaust valve opening, thereby adjusting the amount of the exhaust gases passing through the exhaust conduit 21. The illustrated valve body 25*b* is a disk-shaped, but the valve body 25*b* can have any suitable shape for controlling the flow of exhaust gases passing through the exhaust gas passage 81*a*.

Preferably the valve body 25*b* has a shape that is at least generally similar to the cross sectional profile of the exhaust gas conduit 21*a*. The illustrated valve body 25*b* is attached to the pivot shaft 25*a* for pivotal movement about the axis of the pivot shaft 25*a*. The valve body 25*b* can be moved between an open position (shown in phantom) and the illustrated closed position.

With continued reference to FIG. 3, the exhaust control valve 25 is actuated by the exhaust valve drive system 31. The exhaust valve drive system 31 comprises a drive motor 26 and the drive member 26*a*.

The drive member 26*a* can extend between the drive motor 26 and the control valve 25. In some embodiments, the drive member 26*a* comprises a drive belt, flexible drive member, drive chain, or the like. In some embodiments, for example, the drive member 26*a* is a wire that connects the exhaust control valve 25 to the drive motor 26.

The illustrated drive member 26*a* can have member portions 43 and 45 that are generally parallel to each other. The drive member 26*a* can be configured to engage the outer surface 47 of the pivot shaft portion 49 and the drive motor portion 51.

The illustrated drive member 26*a* is wrapped around the pivot shaft portion 49 and the drive motor portion 51. Thus, the drive member 26*a* engages the periphery of the pivot shaft portion 49 and the drive motor portion 51.

The drive motor 26 can be configured to rotate the drive motor portion 51 to drive the drive member 26*a* and the exhaust control valve 25. In this manner, the drive motor 26 actuates the exhaust control valve 25 via the drive member 26*a*. The drive member 26*a* preferably has a no slip interface with the drive motor portion 51 and the pivot shaft portion 49 for precise control of the exhaust control valve 25.

The exhaust valve drive system 31 preferably comprises a controller 27 that controls the drive motor 26. The illustrated controller 27 is in form of an ECU that controls the operation of the motor 26 based on the operating condition of the engine 15. The controller 27 preferably includes a central processing unit ("CPU") for executing programs (e.g., a control map). The programs or maps can be stored in ROM, RAM, or the like.

The controller 27 can be in communication with one or more detectors or sensors. The operation of the controller 27 can be based, at least in part, on signal(s) from the one or more detectors. In some embodiments for example, the water jet propulsion watercraft 10 has an engine rotational speed detector 28 configured to detect and transmit a signal indicative of the engine rotation speed. The engine rotational speed detector 28 can send a signal to the controller 27, which can actuate the exhaust control valve 25 based on the signal.

As shown in FIG. 2, the engine rotation sensor 28 can be positioned adjacent to the crankshaft of the engine 15 and configured to detect a rotational speed of the crankshaft of the engine 15. The throttle opening sensor 29 can be positioned on a valve shaft of the throttle valve and configured to detect a pivot angle of the throttle shaft.

The rotation sensor 28 and the throttle opening sensor 29 can be configured to send signals to the controller 27. The controller 27 can be configured to control the drive motor 26 based upon those detection signals to achieve a desired position of the exhaust control valve 25. The exhaust control valve 25 can be actuated to different positions for a desired exhaust valve opening based on the operating condition of the engine 15.

In operation, when a start switch of the watercraft 10 is turned on, the engine 15 of the water jet propulsion watercraft 10 starts running. The operator can straddle the seat 13 and can operate the steering handle bar 12 to steer the watercraft 10. The throttle lever can be used to control the engine speed.

While the engine 15 is running, the pivot angle $\alpha$ and exhaust valve opening of the exhaust control valve 25 can be based upon the rotational speed of the engine 15, which is preferably detected by the engine rotation sensor 28.

A control program or map can be used to determine the pivot angle and/or exhaust valve opening based on the rotation speed of the engine 15. The controller 27 can store at least one control map for operating the exhaust control valve 25. A control program or map can be selected or prepared based on the desired exhaust valve opening for one or more engine operating conditions.

Figure 4:
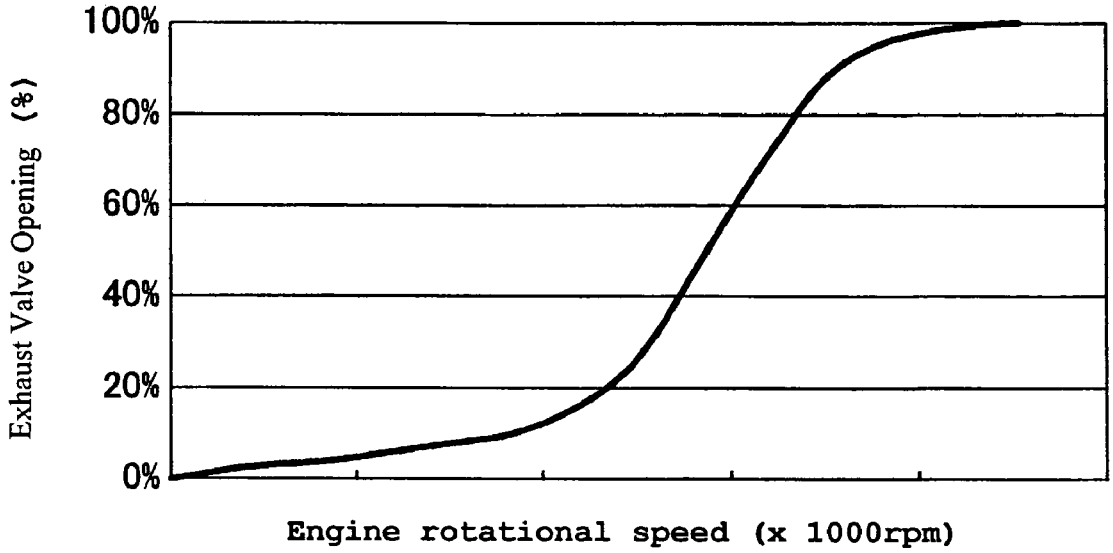
FIG. 4 is a control map indicating relationships between an engine rotational speed and an exhaust valve opening.

FIG. 4 illustrates an exemplary non-limiting control map showing the relationship between the exhaust valve opening and the engine rotational speed. The exhaust valve opening values correspond to the percent that the throttle valve is opened. For example, the throttle valve is completely closed at 0% and fully opened at 100%. The exhaust valve opening is preferably at or close to 0% when the engine rotational speed is at or near 0 rpm. The exhaust valve opening can gradually increase as the engine rotational increases, as shown in FIG. 4. In some embodiments, the throttle valve can be partially open at the 0% setting. In such an embodiment, the small opening allows the engine 15 to run at an idle speed. In other embodiments, the throttle valve can be completely closed at the 0% setting, and an auxiliary air system (not shown) can be configured to provide sufficient air to the engine 15 for idle speed operation.

With continued reference to FIG. 4, the exhaust valve opening is preferably rapidly increased as the engine rotational speed is increased, when the engine rotational speed exceeds the medium speed range and enters a high speed range. That is, the exhaust control valve 25 is closed or slightly opened while the engine rotational speed is in the low or medium speed range. The exhaust control valve 25 can be rapidly opened as the engine rotational speed is increased in the high speed range.

The controller 27 can be configured to use a map, such as the map of FIG. 4, to determine the exhaust valve opening based on the detection signal sent from the engine rotation sensor 28. The controller 27 then controls the drive motor 26 based on the target exhaust valve opening to actuate the exhaust control valve 25 as desired.

In some embodiments, when the rotational speed of the engine 15 is in the medium or low speed range, the exhaust control valve 25 is positioned so that the exhaust pressure in the exhaust conduit 21 between the engine 15 and the exhaust control valve 25 is relatively high. An exhaust pressure wave from the engine 15 can strike the exhaust control valve 25 and at least a portion of the exhaust pressure wave can return to the engine 15. The pressure wave produces an exhaust pulsation effect that can desirably increase the output of the engine 15. Additionally, the exhaust control valve 25 can choke the exhaust gases to reduce the audible noise made during the exhaust discharge.

When the rotational speed of the engine 15 is in the high speed range, the exhaust control valve 25 can be opened to reduce the exhaust resistance thereby increasing the engine output. Thus, the exhaust control valve 25 can be actuated to control the flow and pressure of the exhaust gases flowing through the exhaust system 20.

The exhaust gases discharged from the engine 15 pass through the exhaust conduit 21 and are purified by the catalyst 24. The purified exhaust gases are mixed with the cooling water flowing through the cooling water passage 81*b* at the junction 21*c*. The exhaust/cooling water mixture then is delivered to the water-lock 22.

Because the exhaust control valve 25 is positioned upstream of the junction 21*c* and selectively controls the exhaust gas flow to limit cooling water backflow, the cooling water can continuously flow towards the exhaust outlet 72. The mixture of exhaust gases and the cooling water preferably passes through the water-lock 22 to the exhaust conduit 23. The mixture flows through the exhaust conduit 23 and is expelled from the exhaust outlet 72. The exhaust conduit 23 and the water-lock 22 cooperate to prevent the outside water from flowing towards the engine 15 through the exhaust conduit 23, the water-lock 22, and/or exhaust conduit 21.

The exhaust gases flowing through the exhaust gas passage 81*a* can limit or prevent the cooling water from flowing towards the engine 15 along the exhaust gas passage 81*a*. As the engine speed increases, the amount of exhaust gases flowing through the exhaust gas passage 81*a* is likewise increased to further inhibit the flow of cooling water through the exhaust gas passage 81*a* towards the engine 15.

Additionally, the exhaust control valve 25 can be oriented to inhibit the flow of cooling water through the exhaust gas passage 81*a* towards the engine 15. For example, when the engine 15 operates at low engine speeds, the exhaust control valve 25 can be positioned (e.g., closed) to inhibit the flow of cooling water past the exhaust control valve 25 towards the engine 15.

In some embodiments, the valve opening of the exhaust control valve 25 can be based upon the throttle valve opening detected by the throttle opening sensor 29. The map of FIG. 5 can be used to determine the exhaust valve opening. The exhaust valve opening is at or close to 0% when the throttle opening is at or near 0%. The exhaust valve opening is gradually increased as the throttle opening is increased in a low or medium range engine speed.

Figure 5:
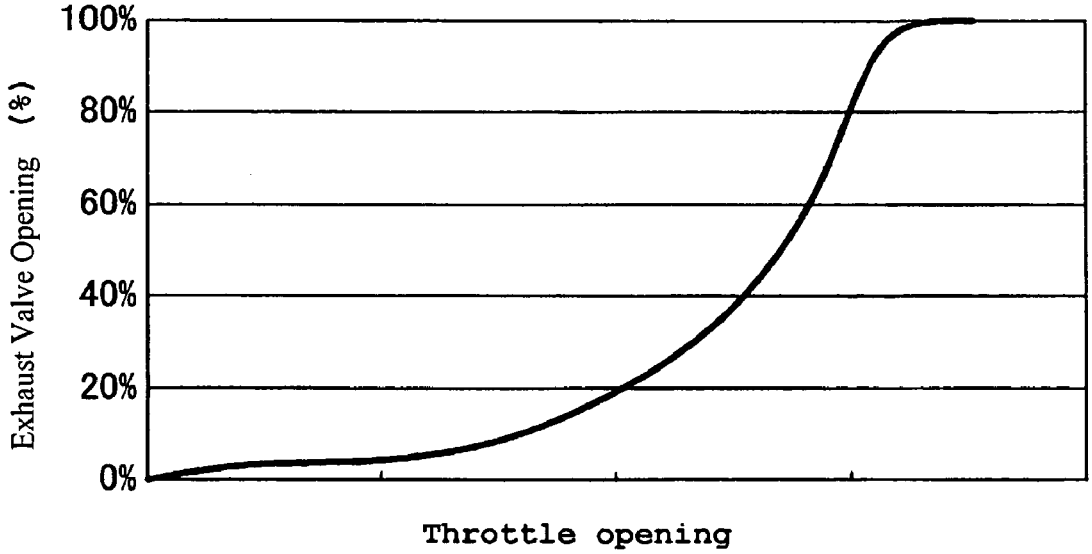
FIG. 5 is a control map indicating relationships between a throttle valve opening and an exhaust valve opening.

The exhaust valve opening is preferably rapidly increased when the throttle opening is in the high range. The rapid increase of the exhaust valve opening based on the throttle opening of FIG. 5 is delayed as compared with the exhaust valve opening based on engine rotational speed of FIG. 4. The controller 27 uses the map of FIG. 5 to determine an exhaust valve opening based upon the detection signal transmitted from the throttle opening sensor 29. The controller 27 then controls the drive motor 26 to actuate the exhaust control valve 25 based upon the target exhaust valve opening.

When the throttle valve opening is in a small or medium range, the output of the engine 15 is improved and the noise following the exhaust discharge is reduced by the exhaust control valve 25. When the throttle valve opening is in a large range (e.g., the throttle valve is fully opened), the exhaust control valve 25 is opened for an increased engine output. When the throttle valve operates in this manner, the cooling water flows through the exhaust conduit 31 towards the exhaust outlet 71 and limits or prevents backflow of the cooling water.

Figure 6:
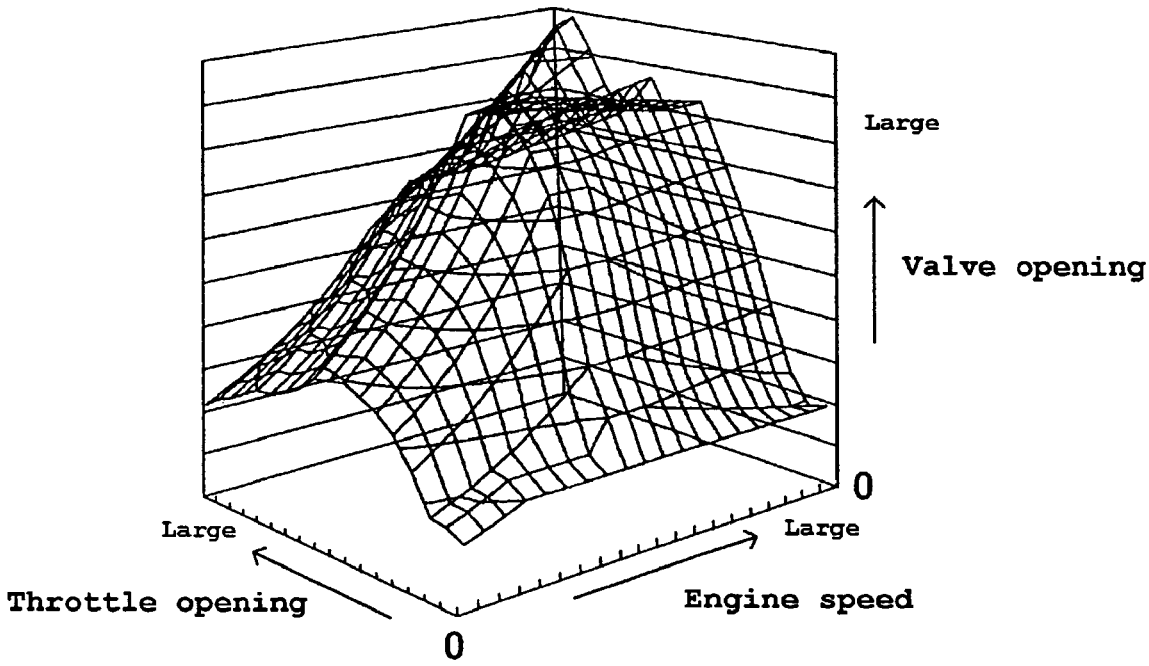
FIG. 6 is a control map indicating relationships of an exhaust valve opening versus the engine rotational speed and the throttle valve opening.

With reference to FIG. 6, the control map illustrated therein shows an exemplary but non-limiting relationship of the exhaust valve opening versus the engine rotational speed and the throttle opening. The controller 27 can use such a map to determine a target exhaust valve opening based upon a signal sent from the engine rotation sensor 28 and/or a signal sent from the throttle opening sensor 29.

The controller 27 can be configured to control the drive motor 26 based on the target exhaust valve opening to actuate the exhaust control valve 25. The target exhaust valve opening can be determined based on the rotational speed of the engine 15, the throttle valve opening, the air/fuel mixture, and/or other operating conditions of the watercraft 10.

The maps of FIGS. 4 through 6 are exemplary embodiments that can be modified or altered as desired. The engine operational conditions as indexes for determining the exhaust valve opening are not limited to the engine rotational speed or the throttle opening. For example, the exhaust pressure in the exhaust conduit 21 and/or the pressure in the water-lock 22 can be used to determine the exhaust valve opening. In some embodiments, for example, a pressure sensor for detecting the exhaust pressure in the exhaust conduit 21 or the water-lock 22 can be in communication with the controller 27. In some embodiments, a control map having a relationship between the exhaust pressure and the exhaust valve opening can be stored and used by the controller 27.

In operation, the exhaust control valve 25 is moved towards a closed position when the rotational speed of the engine is in the medium or low speed range. The exhaust control valve 25 can inhibit the exhaust gas flow such that the exhaust gases are allowed to reversely flow towards the engine. However, the cooling water is inhibited from flowing towards the engine. For example, the exhaust control valve 25 can prevent cooling water from passing past the exhaust control valve 25 towards the engine even though the exhaust pressure in the water-lock 22 is relatively high.

The exhaust control valve 25 can selectively control the amplitude of exhaust pulsations. When the exhaust control valve 25 is in the closed or partially opened position, the amplitude of exhaust pulsations downstream of the exhaust control valve 25 in the exhaust gas passage 81*b* can be less than the exhaust pulsation upstream of the exhaust control. Thus, exhaust pulsations downstream of the exhaust control valve 25 are generally weaker than the exhaust pulsations upstream of the exhaust control valve 25. The exhaust gases and the cooling water mix together downstream of the exhaust control valve 25 at a location where the exhaust pressure wave is relatively low. As such, the cooling water does not flow along the exhaust passage 81*b* and into the engine 15.

In some embodiments, when the engine rotational speed is in the medium speed range or low speed range, the exhaust control valve 25 can be positioned so as to improve engine performance. For example, the exhaust control valve 25 can be closed or partially opened to increase the exhaust pressure as desired. The exhaust pressure wave produced by the engine 15 can be deflected by the exhaust control valve 25 and can return to the engine 15. The exhaust pressure wave returning to the engine 15 can improve the engine output. Additionally, the noise made during the exhaust discharge due to the exhaust choking by the exhaust control valve 25 can be reduced.

The exhaust valve 52 can be operated to reduce exhaust resistance. For example, when the engine rotational speed is in the high speed range, the exhaust valve 52 can be opened to reduce the exhaust resistance to improve engine performance. Thus, the exhaust valve 52 can be moved from a closed position to an open position based on the operating condition of the engine 15. The exhaust control valve 25 can thus be used to enhance engine performance during various operating conditions.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An exhaust system for a watercraft having an engine, the exhaust system comprising an exhaust conduit, the exhaust conduit having an exhaust gas passage through which exhaust gases discharged from the engine pass and a cooling water passage through which cooling water that has cooled the engine passes, a junction that merges the exhaust gases and cooling water, an exhaust control device comprising an exhaust control valve mounted so as to be moveable over a range of motion and positioned such that the entirety of the exhaust control valve, at all positions in the range of motion of the exhaust control valve during operation, is upstream from the junction, and a water lock positioned downstream from the junction, the exhaust control device being configured to control an opening of the exhaust control valve in response to an operating condition of the engine.

2. The exhaust system of claim 1, further comprising a rotational speed detector configured to detect a rotational speed of the engine, the exhaust control device being configured to control the opening of the exhaust control valve in response to a signal from the rotational speed detector.

3. The exhaust system of claim 1, further comprising a throttle valve configured to control an amount of air supplied to the engine, and a throttle opening detector configured to detect an opening of the throttle valve, wherein the exhaust control device is configured to control the opening of the exhaust control valve in response to a signal from the throttle opening detector.

4. The exhaust system of claim 1, further comprising a catalyst configured to purify the exhaust gases, the catalyst being disposed in the exhaust gas passage between the exhaust control valve and the engine.

5. The exhaust system of claim 1, wherein the exhaust control valve comprises a pivot shaft extending generally horizontally within the exhaust gas passage, and a valve body supported by the pivot shaft for pivotal movement about an axis of the pivot shaft.

6. The exhaust system of claim 1, wherein downstream is a general direction the exhaust gases discharged from the engine travel through the exhaust system as they are expelled from the watercraft.

7. The exhaust system of claim 1 in combination with a personal watercraft.

8. The exhaust system of claim 1, wherein the junction is a location where water is discharged from the cooling water passage through a cooling water passage outlet into the exhaust gas passage.

9. The exhaust system of claim 1, wherein the exhaust conduit extends generally horizontally, and the exhaust control valve is spaced generally vertically higher than the junction.

10. The exhaust system of claim 9, wherein the exhaust control valve is positioned generally midway in the vertical direction within the exhaust gas passage.

11. An exhaust system for a watercraft having an engine, the exhaust system comprising an exhaust conduit having an exhaust gas passage and a cooling water passage, the exhaust gas passage being in fluid communication with the engine, the cooling water passage being configured to receive water that has cooled the engine, a junction connected to downstream ends of the exhaust gas passage and the cooling water passage so as to combine together exhaust gases flowing through the exhaust gas passage and cooling water flowing through the cooling water passage, an exhaust control device comprising an exhaust control valve moveable over a range of motion and positioned along the exhaust gas passage such that the exhaust control valve remains completely above cooling water that may flow along the inside of the exhaust gas passage when the exhaust control valve is at any position along its range of motion, wherein the exhaust control device is configured to actuate the exhaust control valve based on an operating condition of the engine, wherein the junction is located upstream from a water lock.

12. The exhaust system of claim 11, wherein the operating condition of the engine is at least one of an engine rotation speed, a throttle opening of a throttle valve that controls air flow to the engine, and an air/fuel ratio delivered to the engine.

13. The exhaust system of claim 11, further comprising a rotational speed detector configured to detect a rotational speed of the engine and to send a signal to the exhaust control device, the exhaust control device configured to control the opening of the exhaust control valve in response to a signal from the rotational speed detector.

14. The exhaust system of claim 11 further comprising a catalyst configured to purify the exhaust gases outputted from the engine, wherein the catalyst is disposed in the exhaust gas passage.

15. The exhaust system of claim 11, wherein the exhaust control valve is mounted to a pivot shaft positioned vertically upward from the junction.

16. The exhaust system of claim 11, wherein the exhaust control device comprises a controller in communication with a drive motor, and a drive member connects the drive motor to the exhaust control valve.

17. The exhaust system of claim 11, wherein the exhaust gas passage extends generally horizontally.

18. The exhaust system of claim 11, wherein the exhaust control valve is positioned within the exhaust gas passage such that the exhaust control valve is not contacted by the cooling water that enters the exhaust gas passage.

19. The exhaust system of claim 11, wherein the junction is a location where the cooling water is discharged from the cooling water passage through a cooling water passage outlet into the exhaust gas passage.

20. The exhaust system of claim 11, wherein the exhaust control valve is configured to be moveable between an open position and a closed position, the exhaust control valve configured to inhibit the exhaust gases in one direction and to inhibit the cooling water in the opposite direction when the exhaust control valve is in the closed position.

21. The exhaust system of claim 20, wherein the exhaust control valve is configured to substantially prevent the flow of the cooling water past the exhaust control valve.

* * * * *